United States Patent [19]

Irvine

[11] Patent Number: 5,052,977

[45] Date of Patent: Oct. 1, 1991

[54] MULTIPLE WEB BUSINESS FORM

[75] Inventor: Harry Irvine, Essex, England

[73] Assignee: Moore Business Forms, Inc., Grand Island, N.Y.

[21] Appl. No.: 435,958

[22] Filed: Nov. 14, 1989

[30] Foreign Application Priority Data

Nov. 11, 1988 [GB] United Kingdom ..... 8826247

[51] Int. Cl.[5] ..... B41L 1/20; B65D 27/06

[52] U.S. Cl. ..... 462/6; 229/69; 229/73

[58] Field of Search ..... 462/6; 229/69, 71, 72, 229/73

[56] References Cited

U.S. PATENT DOCUMENTS

| | | | |
|---|---|---|---|
| 3,312,385 | 4/1967 | Amort | 282/11.5 A |
| 3,837,565 | 9/1974 | Johnsen | 229/68 R |
| 4,342,472 | 8/1982 | Heimann et al. | 282/11.5 A |
| 4,669,652 | 6/1987 | Sequin | 229/73 |
| 4,705,298 | 11/1987 | Van Malderghem et al. | 282/11.5 A |
| 4,840,306 | 6/1989 | Lombardo | 229/69 |
| 4,844,329 | 7/1989 | Dicker | 282/11.5 A |
| 4,852,795 | 8/1989 | Volk, Jr. | 229/69 |
| 4,927,072 | 5/1990 | Jenkins et al. | 282/11.5 A |

FOREIGN PATENT DOCUMENTS 0097421 1/1984 European Pat. Off. .

*Primary Examiner*—Frank T. Yost
*Assistant Examiner*—Hwei-Siu Payer
*Attorney, Agent, or Firm*—Nixon & Vanderhye

[57] ABSTRACT

A multiple web business form stock is provided for forming mailers. A base web is divided transversely by lines of weakening into envelope lengths so that it can be divided into individual mailers. The base web is foldable along a central longitudinal fold line to provide front and back sides of outgoing envelopes. All required preprinted, non-personalized and repetitive information is provided on the base web. Heat sealable adhesive and perforation lines which are necessary for sealing and opening the eventual mailers are provided on the base web. A number of inner webs (e.g. three) are secured to the base web. Each inner web extends substantially the full effective length of the base web, the upper of the inner webs is dimensioned and positioned to receive personalized printed information thereon. The inner webs each have a transverse dimension less than half the transverse dimension of the base web, and are formed with transverse lines of weakening and perforation lines which are aligned with the transverse lines of weakening and perforation lines of the base web.

19 Claims, 6 Drawing Sheets

MULTIPLE WEB BUSINESS FORM

This invention relates to a multiple web business form stock for forming individual mailers, a process for forming such stock and mailers formed therefrom.

A business form stock for forming individual mailers has an indeterminate length very much greater than its width and is divided transversely by lines of weakening into envelope lengths so that it can be divided into individual sealed mailers. Such mailers as received by an addressee can be opened, usually by tearing off marginal portions along one or more lines of perforation adjacent their edges and normally contain an open, pre-addressed, return envelope, a record portion giving information and instructions to the addressee, to be kept by the addressee, and a return stub to be included in the return envelope, either with a cheque or marked with the appropriate information by the original addressee or both.

Such a business form stock can be formed from a single web folded on itself about a central longitudinal fold line to provide front and backsides of an outgoing envelope and as described in European Patent Specification 0097421 a return envelope and a record card and stub.

This invention is concerned with such business form stock in which the outer web is folded upon itself about a central longitudinal fold line.

The present invention is particularly concerned with business form stock to be supplied to the customer with all the non personalised and repetitive information preprinted and all the adhesive and perforations preapplied to the stock but leaving the customer to print personalised information.

The form stock can be supplied to the customers in many physical forms. A popular one, which is perhaps most often requested, is one in which the stock is repeatedly folded back on itself along the horizontal perforation lines which will later be severed to provide separate mailers. Although such a zig zag folding can be accomplished using every such perforation line as a fold line, in practice, the folding is practised only on every second or third or even the fourth such fold line, with the resulting accordian-folded composite being accumulated in a carton.

At the customer's facility or at the facility of the service organisation acting on behalf of the customer, the carton is opened and the lead end of the form stock is fed into a machine, such as a computer-driven variable printer, which successively customizes each potential mailer of the composite web, e.g. by applying a customer's name, account number, address, and amount due together with the same information in bar code or other machine readable form if desired. This information is applied to surfaces internally of what will become the outgoing envelopes typically with an impact printer.

After printing the customer will pass the stock through a plow fold machine which folds it in two, a trimmer which trims off the sprocket receiving holes, a bursting machine to separate the individual mailers from one another for posting and a heat sealing machine which activates the glue to seal the individual mailers around their edges.

With a stock such as disclosed in European Patent Specification 0097421, the amount of information which can be included is limited and an object of the present invention is to provide a form stock, suitable for personalised printing by an individual customer, but with space to contain a considerable amount of information and normally, but not essentially, a return envelope The customer will not need the machinery to collate more than two webs but will have the ability to fold, heat seal and burst a single web.

While Johnson U.S. Pat. No. 3,837,565 discloses a form stock with several inner webs these would not conveniently form a mailers which could be sealed around the inner webs.

The present invention provides a business form stock comprising a base web divided transversely by lines of weakening into envelope lengths so that it can be divided into individual mailers, the base web being designed to be folded along a central longitudinal fold line to provide front and back sides of outgoing envelopes, the stock being preprinted with all the required non-personalised and repetitive information and having applied thereto all the heat sealable adhesive and perforation lines necessary for sealing and opening the eventual mailers, characterised in that the stock contains a plurality of inner webs secured to the base web and each extending substantially the full effective length of the base web, the upper inner web being free to receive personalised printed information.

In one preferred form the invention provides a multiple web business form stock comprising a base web formed with sprocket drive holes along one or both longitudinal edges and divided into a plurality of envelope lengths by transverse lines of weakness, the base web having a longitudinal central fold line dividing the web into upper outgoing envelope sheets and lower outgoing envelope sheets, a longitudinal marginal line of heat sealable adhesive along the marginal edge portion of each said upper envelope sheet inside the sprocket holes, upper and lower marginal lines of heat sealable adhesive adjacent and inside the upper and lower transverse lines of weakness of each upper sheet of each envelope length such that when folded along the fold line and subjected to heat each envelope length will provide a sealed outgoing envelope, marginal lines of perforation extending substantially around each envelope length inside the lines of adhesive so that when the lines of perforation are broken around such a sealed envelope the envelope forming base sheet can be unfolded along the fold line, characterised by a plurality of inner webs each being secured by adhesive along one edge to the web beneath it with the lower of the inner webs being secured along one edge to the base web inside the sprocket holes, the inner webs having a transverse dimension less than half the transverse dimension of the base web, the inner webs being formed with transverse lines of weakening and perforation lines which are aligned with the transverse lines of weakening and perforation lines of the base web.

With such a business form stock, comprising for example three inner sheets, the whole of the inside surface of the upper envelope forming sheet, apart from the window area, is available for printing information to the addressee. Additionally, the whole of both sides of the upper two of the inner webs (which webs extend substantially the full envelope length), apart from the area containing the address and personalised information, is available for pre-printed information or for insertion of information by the addressee while the lower of the inner webs can form a pre-addressed return envelope with the lower outer envelope sheet.

Preferably, the upper inner webs will be adhered to each other (if more than one) and to the base web by longitudinal lines of adhesive preferably extending adjacent the central fold line (with advantage within 1 to 2 mm of that fold line); a line of perforations may allow easy detachment of these sheets after opening the mailer. This helps the folding of the base web and provides that the inner sheets are attached to the lower envelope forming sheet as a booklet after opening of the eventual mailer.

The upper of the inner webs of the composite form stock will be available for the customer to print personalised information, particularly the address of the addressee, and the upper envelope sheet of the base web will preferably include a die cut window covered with transparent material located such that the addressee's address can be seen through this window when the base sheet is folded on itself along the central fold line.

Preferably each of the inner webs is formed with die cut slots between each envelope length above and below each transverse line of weakening , which slots expose adhesive also applied to each lower envelope sheet adjacent such transverse lines. The lines of adhesive on both upper and lower envelope sheets then contact each other to form a good seal despite the thickness of the inner webs.

The invention extends to a method of making such business form stock, and to individual mailers formed therefrom.

One embodiment of business form stock and method and parts for forming such stock and forming mailers therefrom, will now be described, by way of example only, with reference to the accompanying diagrammatic drawings.

DETAILED DESCRIPTION OF DRAWINGS

Figure 1:
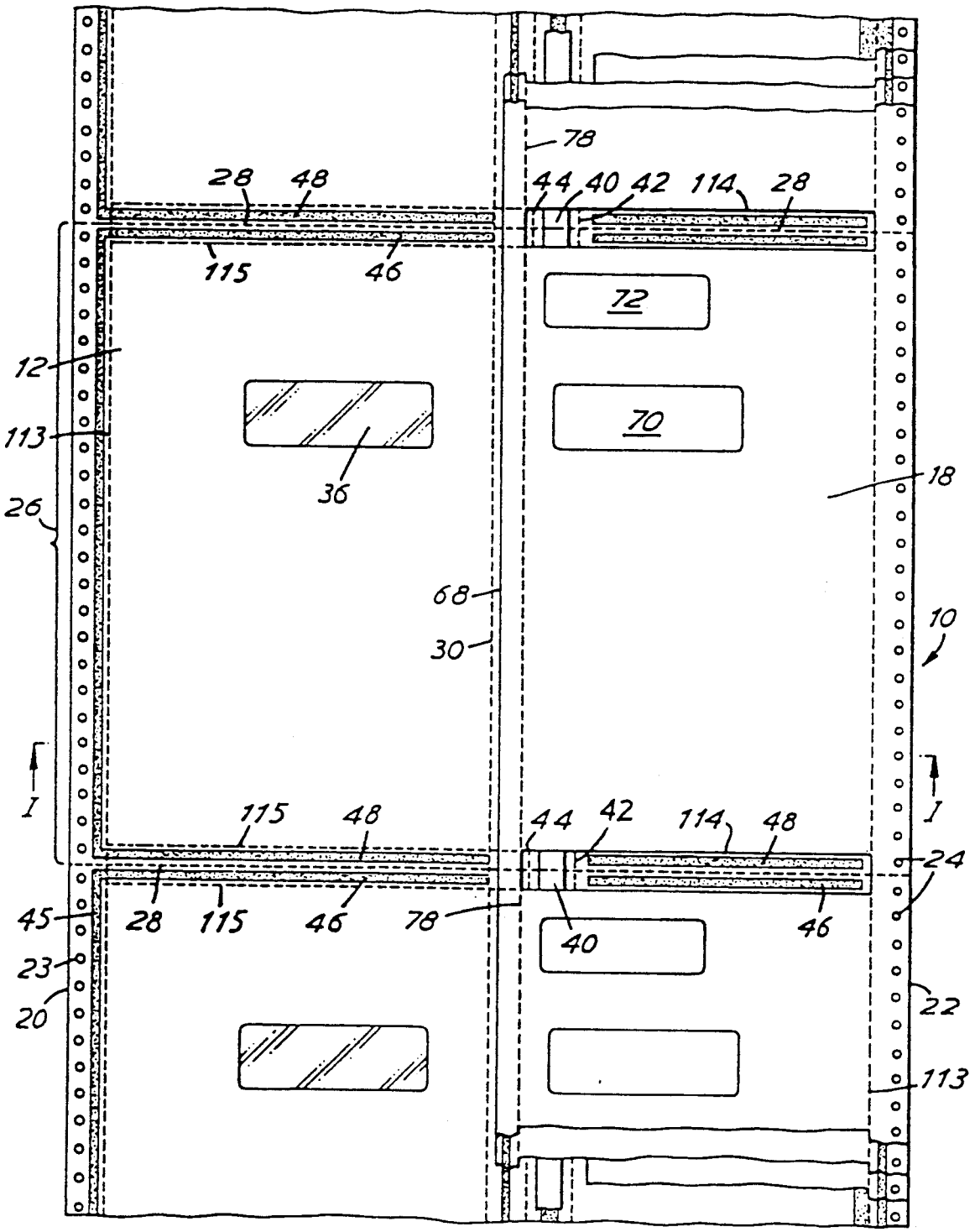
FIG. 1 shows the inner surface of part of a continuous length of business form stock.
Figure 1A:
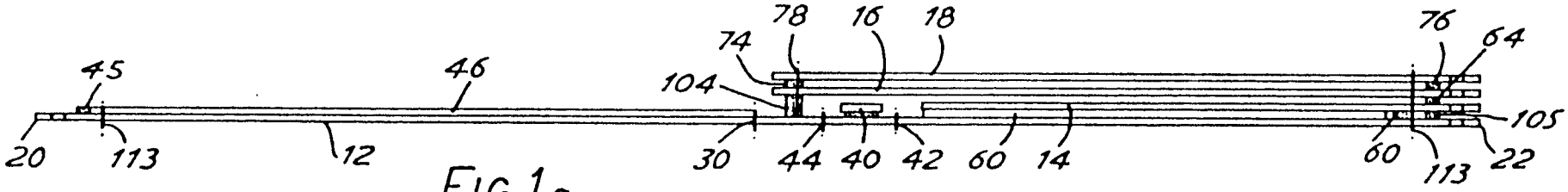
FIG. 1*a* is a diagrammatic section on the line I—I of FIG. 1.

The multiple web business form stock 10 is made up from a longitudinally continuous (indeterminate length) full width base web 12 and a plurality of just under half width inner webs 14, 16, 18. A full width web in this example is 39.6 centimeters wide and is provided along its opposite longitudinal edges 20, 22 with respective longitudinal rows of sprocket pin-receiving holes 23, 24 for driving the stock. The stock is divided into individual envelope lengths indicated by the bracket 26 by transverse lines of weakness 28 extending across the width of the stock. For example envelope length (depth) equals 20.3 cms. In this specification the term "perforation line" is used as a synonym for "line of weakness". The perforation lines 28 are intended for dividing the finished stock into individual mailers.

Figure 2:
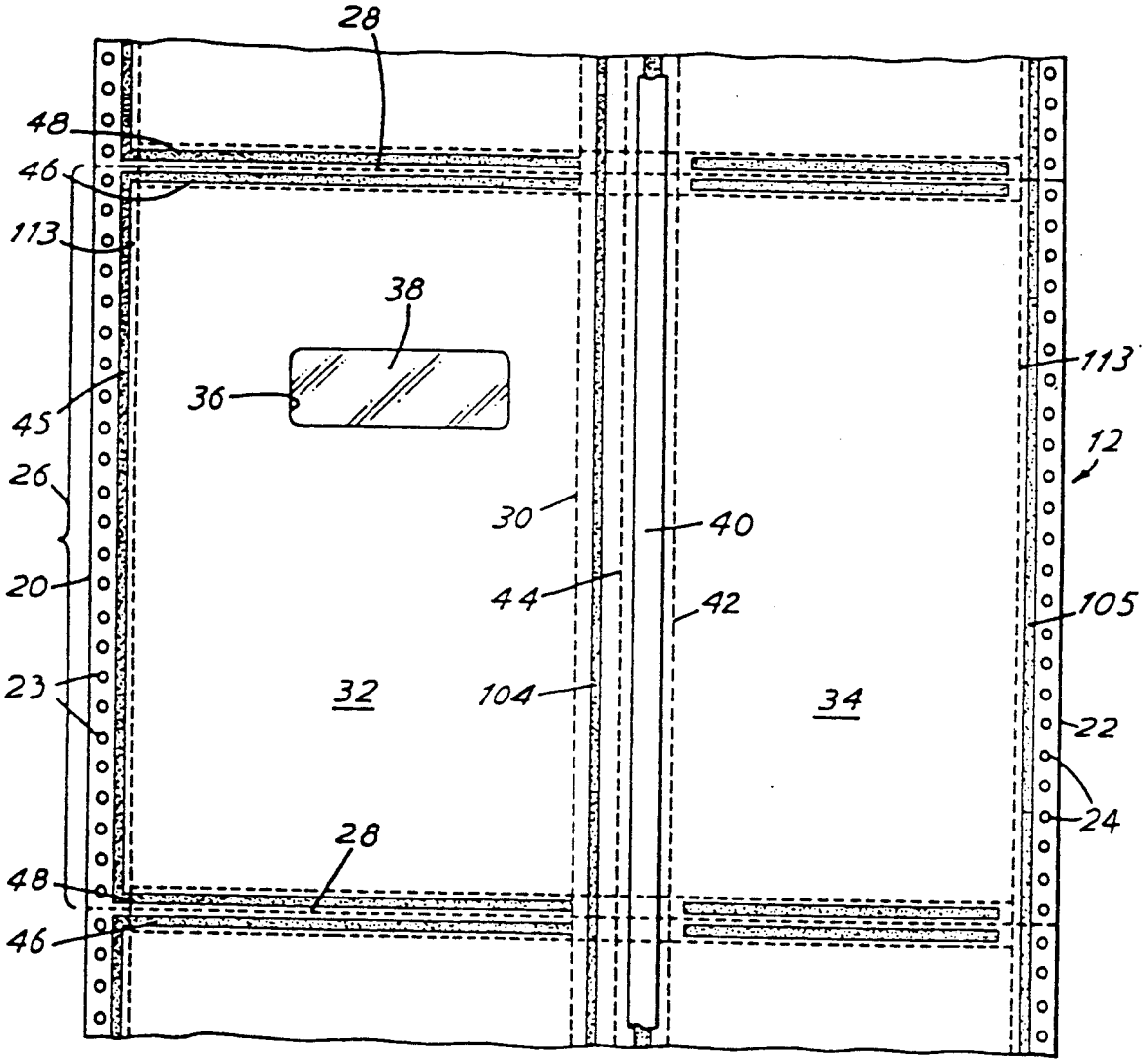
FIG. 2 shows the inner surface of the base web forming part of the stock of FIG. 1.
Figure 3:
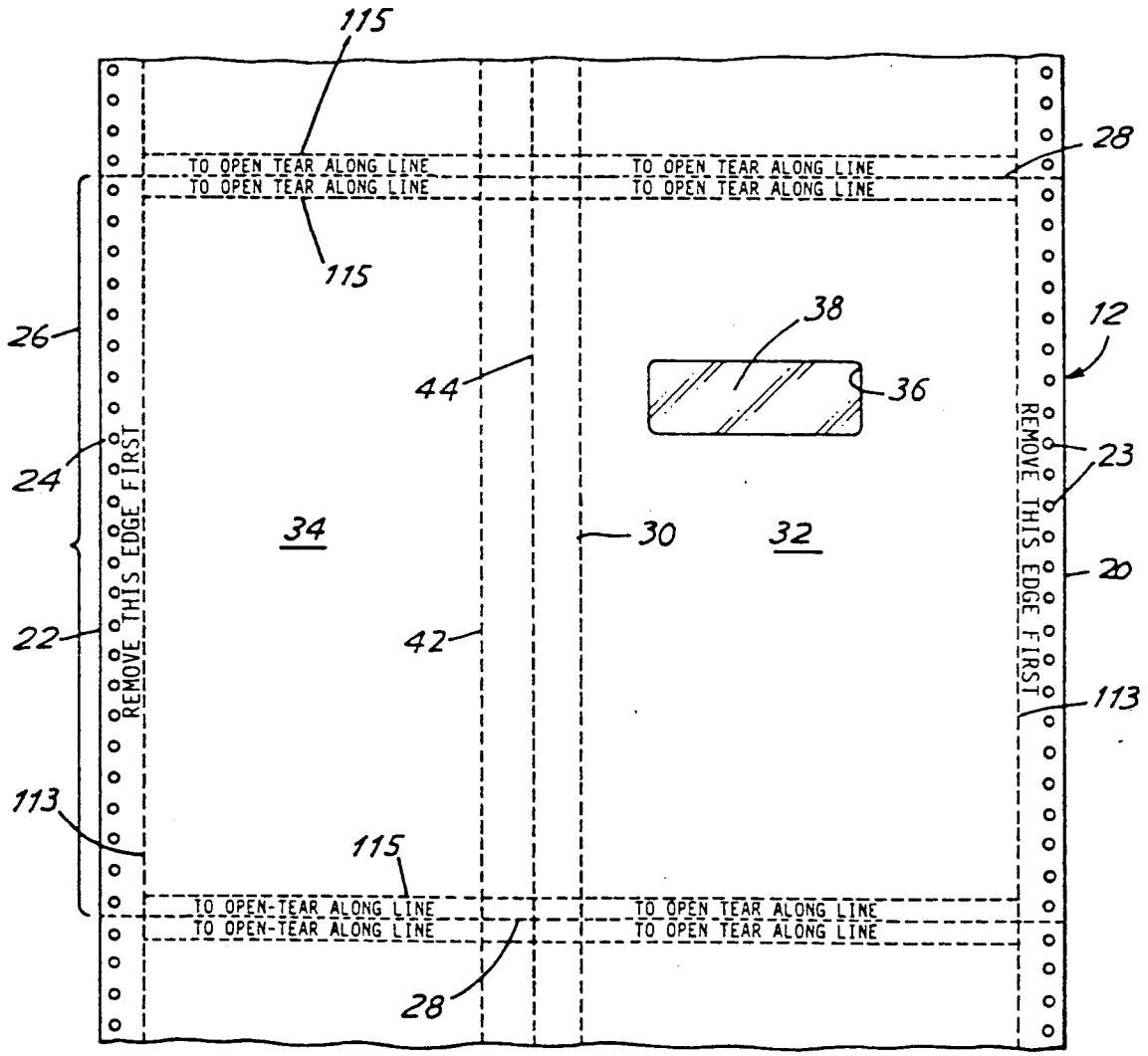
FIG. 3 shows the outer surface of the base web of FIG. 2.

Referring now to FIGS. 2 and 3, the base web 12 is formed with a longitudinal, central fold line 30 such that when the base web is folded on itself about this line, the edges 20, 22 will coincide with the left hand half 32 (as seen in FIG. 2) forming an upper outgoing envelope sheet and the right hand half 34 (as seen in FIG. 2) forming a lower outgoing envelope sheet and a lower return envelope sheet. The upper envelope sheet 32 has die cut therein a window 36 covered in conventional manner with a transparent window patch 38. A strip of adhesive covered by barrier tape and sometimes referred to as Kleen stick tape 40 (or a rewettable glue line) is secured in a longitudinal line spaced to the right of the fold line 30, this strip being secured to the lower outgoing envelope sheet of the base web and forming part of the flap of a return envelope as will be described hereafter. A fold line 42 to assist folding down this flap is formed longitudinally adjacent the strip 40. The further longitudinal perforation line 44 is formed between lines 30 and 42 for detaching the parts 32 and 34 from one another after opening the finished mailer.

A line of heat sealable adhesive 45 is applied in a pattern adjacent the left hand edge of the inner surface of the upper outer envelope forming part 32 adjacent but inside the sprocket holes 24. Similar patterned lines 46, 48 of heat sealable adhesive are applied along the transverse edges of both the upper and lower outer envelope forming parts 32, 34 adjacent the lines of weakness 28. Gaps may be formed in these lines of adhesive to avoid trapping air within the sealed mailer. A gap may be left in the lines 46 and 48 immediately to the right of the longitudinal fold line 30 to avoid tenting of the form stock.

Figure 4:
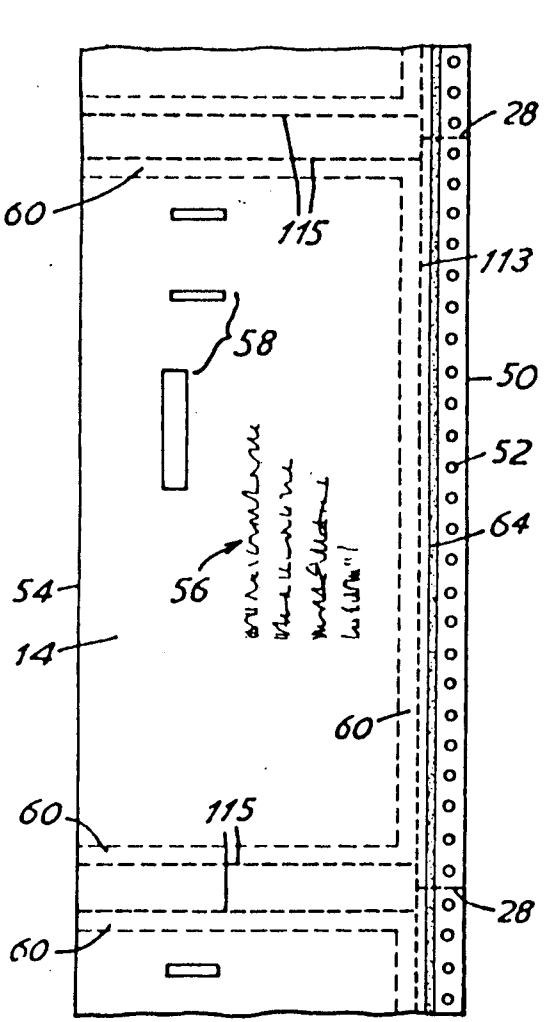
FIG. 4 shows the upper surface of the lower inner web part of the stock of FIG. 1.

Referring next to FIG. 4 which shows the lower 14 of three inner webs, this web having a right hand edge 50 coinciding with the edge 22 of the base web 12 and formed with sprocket holes 52 coinciding with the sprocket holes 24. The left hand edge 54 of this sheet extends to within about 4 centimeters of the central fold line 30 of the base sheet. The upper surface of this sheet is printed with a return address indicated at 56 and either a business reply service licence indication 58 or instructions for sticking a stamp. This web is formed with patterned lines of wet adhesive, on its underside in a C shaped pattern as indicated at 60 extending adjacent but spaced from the upper, lower and right hand edges of each envelope length as will be described later. This web will act as part of the return envelope. The web is also provided, as part of the collation process to be described later, with a line of adhesive 64 applied to its upper surface, between the upright of the C shaped pattern 60 and the sprocket holes.

Figure 6:
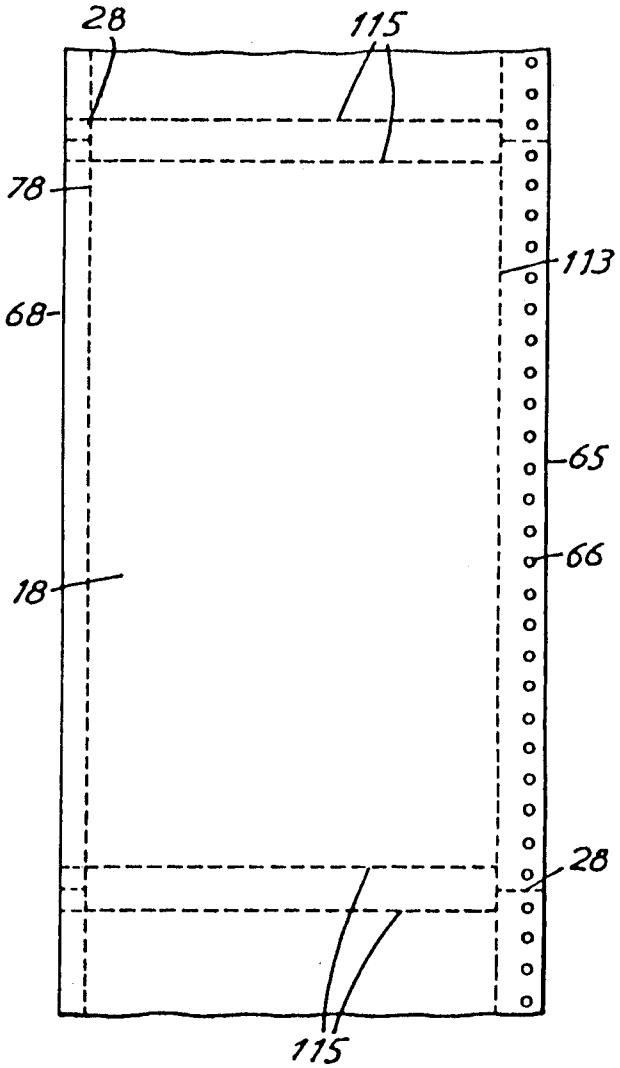
FIG. 6 shows the upper inner web part of the stock of FIG. 1.
Figure 5:
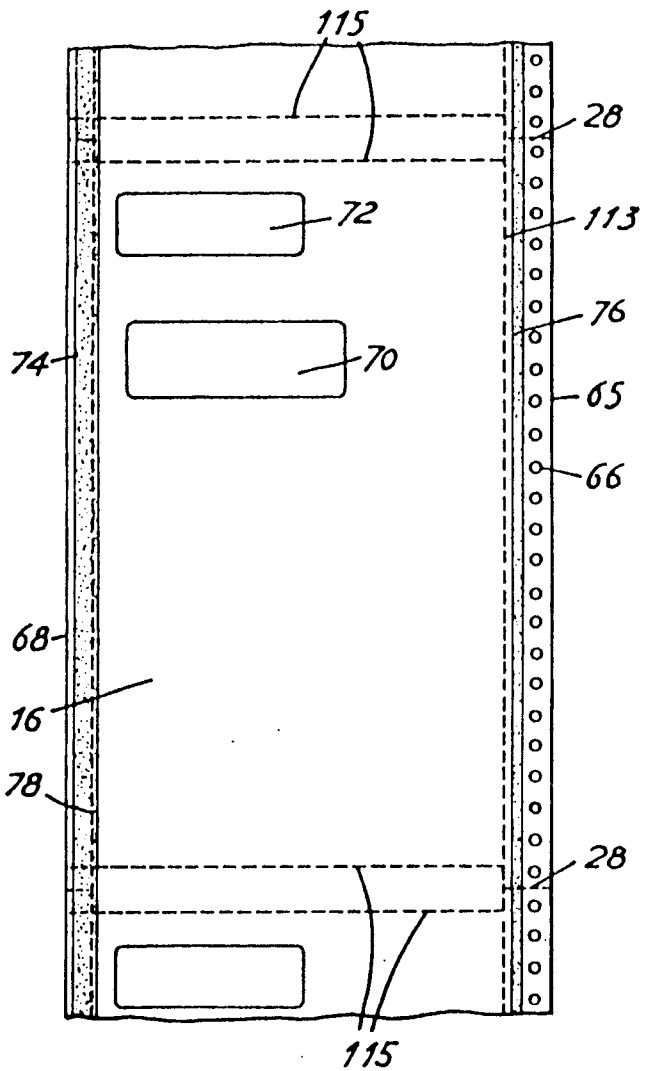
FIG. 5 shows the upper surface of the middle inner web part of the stock of FIG. 1.

Referring next to FIGS. 5 and 6 which show respectively an intermediate inner web and an upper inner web, each of these sheets has a right hand edge 65 coinciding with the edge 22 of the base web and provided with sprocket drive holes 66 coinciding with the sprocket holes 24. The left hand edge 68 of each of these inner webs extends to within one or two millimeters of the central fold line 30. The upper sheet 18 is intended to receive personalised information applied by the customer of the business form stock and for this purpose has an area indicated at 70 for receiving the name and address of the addressee and a further area 72 for receiving bar code information. Other areas may be provided for receiving details of an account number or amount required from the addressee. Apart from the marginal strip portions, the remaining area of both sides of both webs 16 and 18 can be pre-printed with the information to the addressee or spaces and instruction indicating how the addressee should fill in information required to be sent back to the original sender. As shown in FIG. 5, web 16 has applied, at a later stage to be described, longitudinal lines of adhesive 74, 76 adjacent its edges but with line 76 inside the sprocket holes. Both webs 16 and 18 have a line of perforations 78 formed longitudinally to the right of the edges 68 and coinciding with one another in the assembled form stock, but preferably the line of adhesive 74 extends to the right just past the perforation line 78.

Longitudinal and transverse perforation lines 113, 115 extend through all layers around the edge of each mailer. Longitudinal lines 113 extend along opposite edges inside the lines of adhesive 45, 105, 76 and 64. Transverse lines 115 extend between lines 113 below and above the adhesive lines 46 and 48.

Referring back to FIG. 1 it will be seen that when the left hand side of the stock is folded about the longitudinal fold line 30 the window 36 will be above the address receiving area 70 of the web 18 so that the address can be read through the window.

Figure 7:
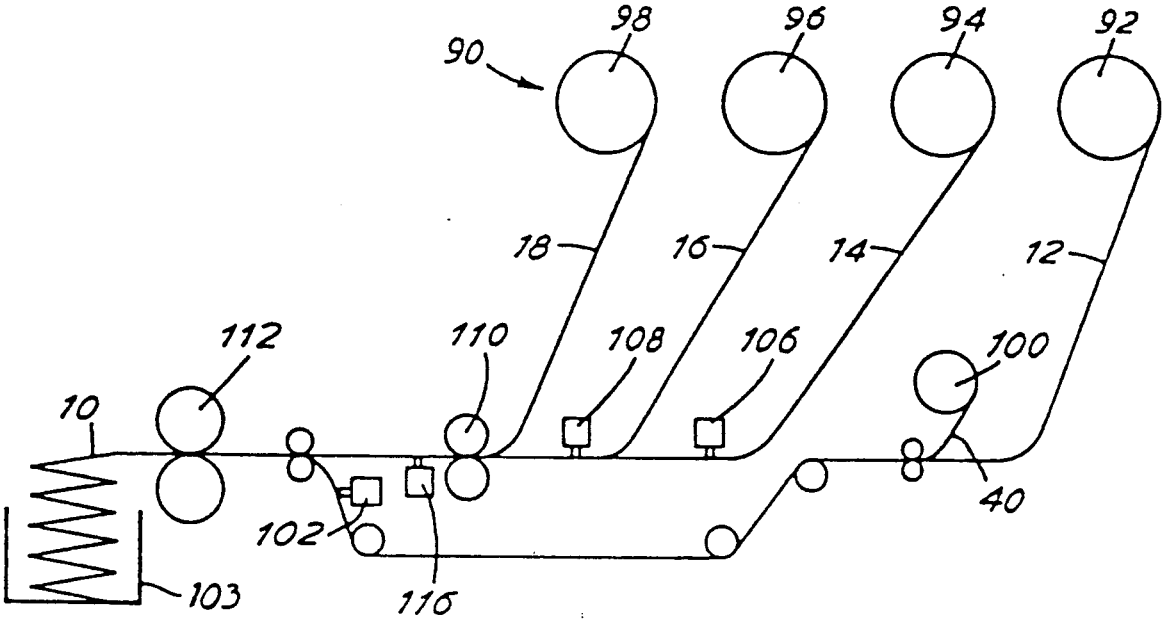
FIG. 7 shows diagrammatically a process line for correlating the webs shown in FIGS. 2 to 6 into the composite business form stock of FIG. 1.

Referring now to FIG. 7, this shows a collating and assembly plant for the stock as indicated at 90, in which separate continuous supplies 92 of base web 12, 94 of lower inner web 14, 96 of middle inner web 16, and 98 of upper inner web 18 are assembled into the composite multiple web stock 10. The web 12 in the supply 92 is of the form shown in FIGS. 2 and 3 with all non-personalised printing thereon and the window formed therein and patched and includes the perforation lines 30, 42 and 44, 113, 115 and the adhesive 45, 46, 48 but not the perforation lines 28 nor the Kleen stick strip. The web 12 from the supply 92 is first collated with the Kleen stick strip 40 from a supply 100 thereof and then passes to a paste unit 102 which supplies longitudinal paste lines 104, 105, respectively adjacent but inside the fold line 30 and the sprocket holes 24.

The web 14 in stack 94 is of the form seen in FIG. 4 except that it does not include any adhesive or perforation lines 28. This web 14 is passed through a paste unit 106 which applies the line of adhesive 64.

The web 16 in stack 96 is of the form shown in FIG. 5 except that it does not include any adhesive or perforation lines 28. The web 16 from stack 96 is passed through paste unit 108 where the longitudinal paste lines 74 and 76 are applied.

The web 18 in the stack 98 is in the form shown in FIG. 6 including all perforation lines except perforation line 28. The webs leaving paste units 106, 108 and stack 98 are fed through a collator 110 which assembles them together so that web 18 is stuck to web 16 along the lines 74 and 76, web 16 is stuck to web 14 along the line 64 and all the webs are aligned. This composite inner web assembly is then fed through a die cut machine which cuts slots 114 (FIG. 1) through the composite inner web above and below the position of each transverse line of weakness 28 and substantially coinciding with lines 115 extending between perforation lines 78 and 113. The composite web is then fed through a further paste unit 116 which applies the C-shaped pattern 60 of adhesive to the under side of the web 14. The composite inner web is then joined with the base web 12 so that the C-shaped pattern of adhesive 60 adheres the web 14 to the base web to form the three glued sides of the return envelope and the lines of gluing 104, 105 secure the outer edge of the web 14 and the left hand edge of the intermediate web 16 to the base web.

The composite stock 10 so formed is now fed through a perforator 112 which produces the transverse perforation lines 28 through all layers. The stock is now folded into a carton 103 for transmission to a customer.

Figure 8:
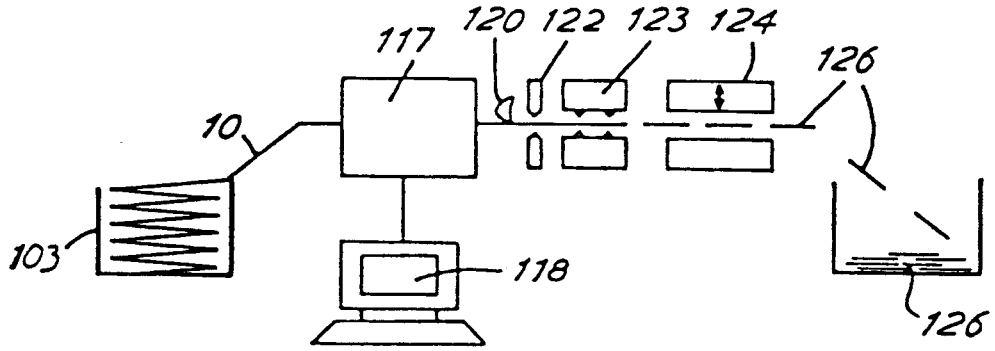
FIG. 8 shows diagrammatically a process line for turning the stock of FIG. 1 into finished mailers of FIG. 1*b*.

As seen in FIG. 8, the customer feeds stock 10 through a printer 117 under control of a computer 118 to provide the personalised printing. The stock is then passed through plow folder 120 where it is folded in half along line 30, a trimmer 122 where the edge is trimmed off, a burster 123 where it is separated into individual mailers 126, and a heat sealing unit 124 where each mailer is sealed around its edge. Each mailer will then be as seen in FIG. 1*b*.

The trimmer acts to cut off the sprocket holes along a line inside the sprocket holes but outside the perforation line 113 in order the leave that edge of the mailer sealed.

Figure 1B:
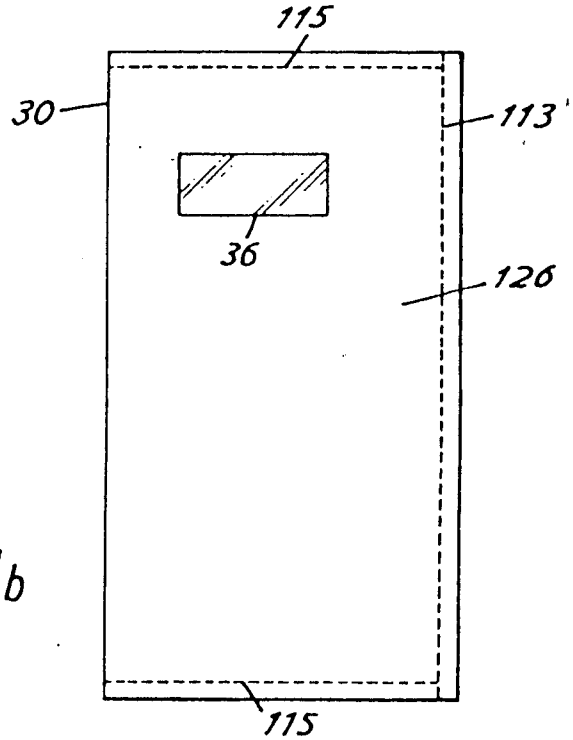
FIG. 1*b* shows diagrammatically a finished mailer formed from the stock of FIG. 1.

As seen in FIG. 1*b*, the mailer is completely sealed by the hot melt adhesive 45, 46, 48 along three edges and the fold line 30 along the fourth edge. To open the mailer, the addressee first tears along the perforation line 113 opposite the fold line, then tears along the perforation lines 115 along the other two edges and finally opens the mailer by unfolding along the fold line 30. The upper and intermediate information bearing sheets 18 and 16 remain attached to the base web 12 by adhesive 64, 74 and so does the return envelope until the addressee is ready to deal with the information and send a reply. The addressee can then tear out the upper and intermediate sheets 18 and 16 along the perforation lines 78. As shown, the glue line 74 between the sheets extends beyond the perforation line 78 so that the sheets remain fastened together as a booklet but can be easily torn apart. This is not essential.

The glue lines 46 on the part 34 in combination with those on part 32 ensure a good seal despite several layers, while the die cuts still reduce tenting and reduce the number of layers which must be torn through along perforations 115.

These sheets are then completed by the addressee as required, the return envelope is detached by tearing along mailer, the information bearing sheets 16 and 18 are secured in the opened mailer in booklet form along their left (or alternatively their top) edges.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

I claim:

1. A business form stock comprising:

a longitudinally continuous base web divided transversely by lines of weakening to envelope lengths so that said base web can be divided into a plurality of individual mailers;

the base web being foldable along a central longitudinal fold line to provide front and back sheets of outgoing envelope portions of said mailers;

said base web adapted to receive preprinted, non-personalized information provided thereon;

adhesive means and perforation line means necessary for sealing and opening said mailers, provided on said base web; and a plurality of inner webs secured to the base web and each extending substantially the full effective length of the base web, said plurality of inner webs including an upper web, an intermediate web and a lower web, wherein said upper web and said intermediate web are attached to each other and to the base web adjacent said longitudinal fold line, said upper of said inner webs delineated for and adapted to receive personalized printed information thereon, and said lower of said inner webs adhered to the back sheets of the outgoing envelope portions to form return envelopes arranged so that a free edge of said lower of said inner webs defines top openings in said return envelopes facing said central longitudinal fold line.

2. A business form stock according to claim 1 wherein each said plurality of inner webs is formed with die-cut slots between each envelop length extending above and below each transverse line of weakening.

3. A business form stock according to claim 2 wherein an inside surface of each back sheet of said outgoing envelope portions is provided with transverse lines of adhesive adjacent the transverse lines of weakening.

4. A business form stock according to claim 1 wherein an inside surface of each front sheet of said outgoing envelope portions has a die-cut window formed therein.

5. A business form stock according to claim 1 wherein for each mailer, said upper of said plurality of inner webs extend for the majority of the width of the back sheet of the outgoing envelope portions and said lower of said inner webs extends to within 1 to 2 mm of the central longitudinal fold line.

6. A business form stock according to claim 1 wherein each of said plurality of inner webs has a drive means along one edge coincident with a drive means along a corresponding edge of the back sheets of the outgoing envelope portions of the base web.

7. A business form stock comprising:

a longitudinally continuous base web divided transversely by lines of weakening to envelope lengths so that it can be divided into individual mailers;

the base web being foldable along a central longitudinal fold line to provide front and back sheets of outgoing envelope portions of said mailers;

said base web adapted to receive preprinted, non-personalized information provided thereon;

adhesive means and perforation line means necessary for sealing and opening said mailers, provided on said base web; and a plurality of inner webs secured to the base web and each extending substantially the full effective length of the base web, uppermost of the inner webs delineated for and adapted to receive personalized printed information thereon; and wherein at least two of said plurality of inner webs are attached to each other and the base web adjacent said longitudinal fold line.

8. A business form stock comprising:

a longitudinally continuous base web divided transversely by lines of weakening to envelope lengths so that it can be divided into individual mailers;

the base web being foldable along a central longitudinal fold line to provide front and back sheets of outgoing envelope portions of said mailers;

said base web adapted to receive preprinted, non-personalized information provided thereon;

adhesive means and perforation line means necessary for sealing and opening said mailers, provided on said base web; and a plurality of inner webs secured to the base web and each extending substantially the full effective length of the base web, uppermost of the inner webs delineated for and adapted to receive personalized printed information thereon; and wherein said plurality of inner webs are glued to each other and said base web so that after initial opening of an outgoing envelope portion the inner webs are still attached to the base web.

9. A multiple web business form stock comprising:

a base web formed with sprocket drive holes along at least one of a pair of longitudinal edges, and divided into a plurality of envelope lengths by transverse lines of weakness, and a longitudinal central fold line dividing the web into upper outgoing envelope sheets and lower outgoing envelope sheets;

a longitudinal marginal line of adhesive along the marginal edge portion of each said upper envelope sheet, inside said sprocket holes;

upper and lower marginal lines of adhesive adjacent and inside the upper and lower transverse lines of weakness of each upper sheet of each envelope length so that when folded along the fold line and subjected to heat each envelope length will provide a sealed outgoing envelope;

marginal lines of perforation extending substantially around each envelope length inside the lines of adhesive so that when the lines of perforation are broken around such a sealed envelope the envelope forming base sheet can be unfolded along the fold line;

a plurality of inner webs each being secured by adhesive along one edge to said base web beneath it with the lowermost of the inner webs being secured along one edge to the base web inside the sprocket holes to form return envelopes in cooperation with the lower outgoing envelope sheets, said return envelopes each having a free edge facing said central fold line and defining a top opening therein;

said inner webs each having a transverse dimension less than half the transverse dimension of the base web; and said inner webs being formed with transverse lines of weakening and perforation lines which are aligned with the transverse lines of weakening and perforation lines of the base web.

10. A business form stock according to claim 10 wherein an inside surface of each outgoing envelope sheet has a die-cut window formed therein.

11. A business form stock according to claim 9 wherein there are at least two inner webs which extend for the majority of the width of the lower outgoing envelope sheet of the base web and at least one of which extends to within 1 to 2 mm of the central longitudinal fold line.

12. A business form stock according to claim 9 wherein the lowermost of the inner webs is adhered to the lower envelope sheet of the base web to form a return envelope.

13. A business form stock according to claim 9 wherein each of the inner webs has a drive means along one edge coincident with the sprocket drive holes along the edge of the lower envelope sheet of the base web.

14. A multiple web business form stock comprising:

a base web formed with sprocket drive holes along at least one of a pair of longitudinal edges, and divided into a plurality of envelope lengths by transverse lines of weakness, and a longitudinal central fold line dividing the web into upper outgoing envelope sheets and lower outgoing envelope sheets;

a longitudinal marginal line of adhesive along the marginal edge portion of each said upper envelope sheet, inside said sprocket holes;

upper and lower marginal lines of adhesive adjacent and inside the upper and lower transverse lines of weakness of each upper sheet of each envelope length so that when folded along the fold line and subjected to heat each envelope length will provide a sealed outgoing envelope;

marginal lines of perforation extending substantially around each envelope length inside the lines of adhesive so that when the lines of perforation are broken around such a sealed envelope the envelope forming base sheet can be unfolded along the fold line;

a plurality of inner webs each being secured by adhesive along one edge to said base web beneath it with the lowermost of the inner webs being secured along one edge to the base web inside the sprocket holes;

said inner webs each having a transverse dimension less than half the transverse dimension of the base web; and said inner webs being formed with transverse lines of weakening and perforation lines which are aligned with the transverse lines of weakening and perforation lines of the base web; and wherein at least two of the inner webs are attached to each other and the base web adjacent said longitudinal fold line.

15. A multiple web business form stock comprising:

a base web formed with sprocket drive holes along at least one of a pair of longitudinal edges, and divided into a plurality of envelope lengths by transverse lines of weakness, and a longitudinal central fold line dividing the web into upper outgoing envelope sheets and lower outgoing envelope sheets;

a longitudinal marginal line of adhesive along the marginal edge portion of each said upper envelope sheet, inside said sprocket holes;

upper and lower marginal lines of adhesive adjacent and inside the upper and lower transverse lines of weakness of each upper sheet of each envelope length so that when folded along the fold line and subjected to heat each envelop length will provide a sealed outgoing envelope;

marginal lines of perforation extending substantially around each envelope length inside the lines of adhesive so that when the lines of perforation are broken around such a sealed envelope the envelope forming base sheet can be unfolded along the fold line;

a plurality of inner webs each being secured by adhesive along one edge to said base web beneath it with the lowermost of the inner webs being secured along one edge to the base web inside the sprocket holes;

said inner webs each having a transverse dimension less than half the transverse dimension of the base web; and said inner webs being formed with transverse lines of weakening and perforation lines which are aligned with the transverse lines of weakening and perforation lines of the base web; and wherein each of the inner webs is formed with die-cut slots between each envelope length extending above and below each transverse line of weakening.

16. A business form stock according to claim 15 wherein each lower envelope sheet is provided with transverse lines of adhesive adjacent the transverse lines of weakening.

17. A multiple web business form stock comprising:

a base web formed with sprocket drive holes along at least one of a pair of longitudinal edges, and divided into a plurality of envelope lengths by transverse lines of weakness, and a longitudinal central fold line dividing the web into upper outgoing envelope sheet sand lower outgoing envelope sheets;

a longitudinal marginal line of adhesive along the marginal edge portion of each said upper envelope sheet, inside said sprocket holes;

upper and lower marginal lines of adhesive adjacent and inside the upper and lower transverse lines of weakness of each upper sheet of each envelope length so that when folded along the fold line and subjected to heat each envelope length will provide a sealed outgoing envelope;

marginal lines of perforation extending substantially around each envelope length inside the lines of adhesive so that when the lines of perforation are broken around such a sealed envelope the envelope forming base sheet can be unfolded along the fold line;

a plurality of inner webs each being secured by adhesive along one edge to said base web beneath ti with the lowermost of the inner webs being secured along one edge to the base web inside the sprocket holes;

said inner webs each having a transverse dimension less than half the transverse dimension of the base web; and said inner webs being formed with transverse lines of weakening and perforation lines which are aligned with the transverse lines of weakening and perforation lines of the base web; and wherein the inner webs are glued to each other and the base web so that after initial opening of an outgoing envelope the inner webs are still attached to the base web.

18. A mailer comprising:

a base web foldable along a central fold lien to provide front and back sheets of an outgoing envelope;

said base web adapted to receive preprinted, non-personalized information provided thereon;

adhesive means and perforation line means necessary for sealing and opening said mailer provided on said base web; and a plurality of inner webs secured to the base web, at least two of said plurality of inner webs secured to each other and to the base web adjacent the central fold line and each extending substantially the full effective length of the base web, the upper of the inner webs delineated for and adapted to receive personalized printed information thereon.

19. A mailer comprising:

a base web foldable along a central fold line to provide front and back sides of an outgoing envelope;

a said base web adapted to receive preprinted, non-personalized information provided thereon;

adhesive means and perforation line means necessary for sealing and opening said mailer provided on said base web; and a plurality of inner webs secured to the base web and each extending substantially the full effective length of the base web;

wherein said base web is formed with sprocket drive holes along at least one of a pair of longitudinal edges; and wherein said adhesive means comprises a longitudinal marginal line of adhesive along a marginal edge portion thereof, inside said sprocket holes, and upper and lower marginal lines of adhesive adjacent and inside transverse edges so that when the base web is folded along the fold line and said adhesive means activated a sealed outgoing envelope is provided; and wherein said perforation line means comprises marginal lines of perforation extending substantially around the envelope length inside the lines of adhesive so that when the lines of perforation are broken around a sealed envelope, the base web can be unfolded along the fold line; and wherein each of said inner webs has a transverse dimension less than half the transverse dimension of said base web, and the inner webs are formed with transverse lines of weakening and perforation lines which are aligned with the transverse lines of weakening and perforation lines of the base web.

* * * * *